United States Patent [19]

Lee et al.

[11] Patent Number: 5,070,240

[45] Date of Patent: Dec. 3, 1991

[54] APPARATUS AND METHODS FOR TRACE COMPONENT ANALYSIS

[75] Inventors: Milton L. Lee, Pleasant Grove; Chung H. Sin, Provo, both of Utah

[73] Assignee: Brigham Young University, Provo, Utah

[21] Appl. No.: 574,638

[22] Filed: Aug. 29, 1990

[51] Int. Cl.[5] ..... H01J 49/40

[52] U.S. Cl. ..... 250/288; 250/287; 250/286

[58] Field of Search ..... 250/288, 288 A, 287, 250/286

[56] References Cited

U.S. PATENT DOCUMENTS

| | | | |
|---|---|---|---|
| 3,621,240 | 11/1971 | Cohen et al. | 250/287 |
| 4,072,862 | 2/1978 | Mamyrin et al. | 250/287 |
| 4,390,784 | 6/1983 | Browning et al. | 250/287 |
| 4,458,149 | 7/1984 | Muga | 250/287 |
| 4,667,100 | 5/1987 | Lagna | 250/288 A |
| 4,731,532 | 3/1988 | Frey et al. | 250/287 |

OTHER PUBLICATIONS

Wiley et al., The Review of Scientific Instruments, vol. 26, No. 12, Dec. 1955, pp. 1150–1157.

Opsal et al., Anal. Chem., vol. 57, No. 9, Aug. 1985, pp. 1884–1889.

Lubman et al., Rev. Sci. Instrum. 56(3), Mar. 1985, pp. 373–376.

Engelking, Rev. Sci. Instrum. 57(9), Sep. 1986, pp. 2274–2277.

Pollard et al., Rev. Sci. Instrum. 58(1), Jan. 1987, pp. 32–37.

Pollard et al., Rev. Sci. Instrum. 60(10), Oct. 1989, pp. 3171–3180.

T. W. Carr (Ed.), Plasma Chromatography, Plenum Press, New York 1984, pp. 1–41.

A. Good et al., "Mechanism and Rate Contents of Ion-Molecule Reactions Leading to Formation of $H^+(H_2O_n)$ in Moist Oxygen and Air", J. Chem. Phys., vol. 52, No. 1, 1970, pp. 222–229.

*Primary Examiner*—Jack I. Berman

*Attorney, Agent, or Firm*—Pennie & Edmonds

[57] ABSTRACT

A method an apparatus for analyzing chemical species includes an ion source at or near ambient pressure and a time-of-flight mass spectrometer which receives the ions, created at the ion source, through an ion supersonic jet forming device. The ion source creates ions from neutral molecules in the sample to be analyzed or serves to introduce already formed ions into the mass spectrometer vacuum chamber. The ion source can use any of the known techniques for ion creation, including a corona discharge or a $^{63}$Ni Beta ion source. The ions are created and are then inroduced into the vacuum region of the mass spectrometer through a small orifice which causes the stream of ions entering the vacuum region to enter as a supersonic jet wherein the kinetic energy of each individual ion falls within a narrow energy band. The ions are then repelled or drawn into the field-free flight tube of the mass spectrometer and separated and identified based on their mass-to-charge ratios.

51 Claims, 2 Drawing Sheets

APPARATUS AND METHODS FOR TRACE COMPONENT ANALYSIS

BACKGROUND OF THE INVENTION

1. Field of the Invention

This invention relates to an apparatus and a method for analyzing chemical species utilizing a time-of-flight mass spectrometer. The invention further relates to improvements in the speed and sensitivity of analysis of such chemical species. Ions are formed from such species using ionization techniques such as ion-molecule reactions, thermospray, electrospray, laser ionization, and other known ionization methods. The characterization of such species is carried out through mass analysis in a time-of-flight mass spectrometer. The invention also relates to the improvement in mass resolution of ions produced from species of interest in a time-of-flight mass spectrometer. The improvement in mass resolution is brought about by the use of a supersonic ion jet in conjunction with complementary ion optics.

2. Description of the Prior Invention

Prior technology used in the analysis of the chemical species is exemplified by Cohen et al., U.S. Pat. No. 3,621,240, which describes the use of a mass spectrometer and an ion mobility detector. Quadrupole and sector mass spectrometers are widely used in chemical species analysis. These mass spectrometers suffer from several limitations. The sensitivity of the most commonly used ionization method, electron impact ionization, is limited by its ionization efficiency, which is only about $10^{-3}\%$. To obtain a complete mass spectrum, a technique is usually used where the whole mass range is scanned, sequentially admitting ions of increasing mass-to-charge ratio to an electron multiplier. This technique causes the loss of the majority of the ions produced. A complete mass spectrum typically takes greater than one second to scan, which is significantly slower than the times associated with obtaining complete mass spectra using a time-of-flight mass spectrometer.

An ion mobility detector, also known as a plasma chromatograph, has the advantage of producing an ion mobility spectrum in several tens of milliseconds. The ion mobility detector has been described in detail in the book "Plasma Chromatography" edited by T.W. Carr, Plenum Press: New York, 1984. It is operated at ambient pressure and does not require vacuum pumping. The most significant problem with the ion mobility detector is its poor resolution, which is typically 50 or less. For comparison, a typical resolution achieved using a quadrupole mass spectrometer is 300 at a mass-to-charge ratio of 300. Also, ion mobility is dependent not only on the molecular weight, but also on the size, shape, and charge density of the molecule. It is therefore very difficult to identify a compound from the spectrum alone, without comparison with an analysis conducted using a standard compound.

The problems of low sensitivity and long analysis time can be solved by using a time-of-flight mass spectrometer. The most commonly used time-of-flight mass spectrometer was described in detail in the paper by Wiley and McLaren, "Time-of-Flight Mass Spectrometer with Improved Resolution", Rev. Sci. Instrum., Vol. 26, No. 12, (1955), p. 1150. Basically, in a time-of-flight mass spectrometer, ions are produced and pulsed into a field free drift region. Assuming that all of the ions attain the same amount of energy, they will then travel in the field-free region at velocities in accordance with their mass-to-charge ratios. The mass spectrum is then a measurement of ion signals detected at different times. The advantages of a time-of-flight mass spectrometer include speed and sensitivity. A complete mass spectrum takes less than 1 millisecond to obtain. The sensitivity of a time-of-flight mass spectrometer is generally one to two orders of magnitude better than quadrupole or sector instruments.

The mass resolution of a conventional time-of-flight mass spectrometer is dependent upon the mass-to-charge ratio and is approximately 300 to 400 at a mass-to-charge ratio of 300. Much higher resolution can be obtained in a sector mass spectrometer, which can achieve a resolution of several thousand. Sector mass spectrometers are very complicated and expensive which makes them impractical for routine field analysis. The time-of-flight mass spectrometer is simpler, faster, and cheaper, but its resolution is below that of the sector instruments.

One factor contributing to the relatively poor mass resolution obtained in time-of-flight mass spectrometers (when compared to sector mass spectrometers) is the initial energy spread of the ions introduced into the field-free drift tube. In other words, ions of the same mass-to-charge ratio introduced into the flight tube at the same time and same position do not reach the detector at the same time because the initial energy of the ion influences the flight time. If all ions of the same mass and charge were to have the same initial kinetic energy and begin flight at the same time from the same position, they would reach the detector at the end of the flight tube at the same time, and infinite resolution would be achieved. Obviously, this ideal case of infinite resolution cannot be achieved because the three primary factors influencing the width of the resulting peak, or resolution, are never identical for each ion. These factors include the starting position of the ion, the time the ion flight begins, and the initial kinetic energy of each ion. Peak broadening, or a decrease in resolution, results from a combination of these three factors.

Past attempts to improve the mass resolution include ion reflection as disclosed in U.S. Pat. No. 4,072,862 to Mamyrin et al. and velocity compaction as disclosed in U.S. Pat. No. 4,458,149 to Muga et al. Both of these methods use post-acceleration add-on devices to compensate for the initial energy spread. Complicated electronics and precision machining are required to build apparatus for both of these methods.

On the other hand, the present invention uses a simple means to improve the mass resolution in a time-of-flight mass spectrometer. The ions produced in the ion source are first expanded into a supersonic jet through a small orifice which connects the ion source to the mass spectrometer vacuum chamber. A supersonic jet is a stream of molecules or ions formed as the molecules or ions flow from a higher pressure region into a region of significantly lower pressure through an opening. When the opening dimensions are much larger than the mean-free path of the molecules or ions, the molecules or ions enter the lower pressure region forming a supersonic jet. The ions or molecules in the supersonic jet have a statistical average direction or axis of flow. The supersonic expansion in the jet causes a narrowing in the energy distribution of the molecules and ions in the jet. As the ions expand through the small orifice, their internal and kinetic energies are shared through two-body collisions, and their energies become more equalized and are converted into directed mass motion. Therefore, ions forming the supersonic jet, or beam, inside the time-of-flight mass spectrometer will have very similar velocities, and subsequently the mass resolution of the instrument will be improved.

Supersonic expansions have been used to introduce neutral molecules, which are later ionized, into time-of-flight mass spectrometers using techniques described by Lubman and Jordan, "Design for Improved Resolution in a Time-of-Flight Mass Spectrometer using a Supersonic Beam and Laser Ionization Source" Rev. Sci. Instrum., Vol. 56, No. 3, (1985), p. 373, and Opsal et al., "Resolution in the Linear Time-of-Flight Mass Spectrometer", Anal. Chem., Vol. 57, No. 9, (1985), p. 1884. In both of these techniques, the neutral molecules are ionized with a UV laser beam after expansion of the supersonic jet into the mass spectrometer. The use of a laser to achieve ionization makes these techniques impractical for routine analysis. Laser ionization is an expensive method of ionization and makes the use of instruments using the technique too expensive to be used widely for routine analysis. The present invention uses an approach in which the ionization is carried out before the expansion of the sample through a small orifice or opening to form the supersonic jet. The supersonic jet then consists of both neutral molecules and ions. Engelking, "Corona Excited Supersonic Expansion", Rev. Sci.Instrum., Vol. 57, No. 9, (1986), p. 2274, has studied the energy states of ions in a supersonic jet; however, the use of supersonic ion jets has not been used to improve resolution in mass spectrometry.

Ionization of a molecular beam expanding through the small orifice can be achieved inside the mass spectrometer, not only by means of laser excitation, but also by electron impact. In electron impact ionization techniques, the distributions of internal and kinetic energies of the ions are broadened. Thus, the resolution achieved in the mass spectral analysis is lowered, because the ions entering the field-free flight tube have a spectrum of energies and their flight times are influenced by the internal and kinetic energies they possess at the times they enter the flight tube. Thus, electron impact is not practical for use in this manner in a time-of-flight mass spectrometer. Laser ionization is preferable for ionization of the molecular jet inside the mass spectrometer, but because of the complexity and expense required in laser ionization, it is impractical to use laser ionization in routine analysis with a time-of-flight mass spectrometer. Ionization at ambient pressure outside of the mass spectrometer vacuum and introduction of the ionized sample through a supersonic jet is a practical and effective method usable in routine analysis.

By placing the field-free drift tube at an angle to the axis of the directional flow of the supersonic jet beam or stream, the forward movement or energy of the ions entering the tube will not be a significant factor contributing to ion peak broadening. Pollard et al., "Electron-Impact Ionization Time-of-Flight Mass Spectrometer for Molecular Beams", Rev. Sci. Instrum., Vol. 58, No. 1, (1987), p. 32, and "Time-Resolved Mass and Energy Analysis by Position-Sensitive Time-of-Flight Detection", Rev. Sci. Instrum., Vol. 60, No. 10, (1989), p. 3171, have described the use of a flight tube perpendicular to the axis of a supersonic jet molecular beam. However, because the mass spectrometer requires ions to perform its analysis, Pollard et al. had to ionize the molecular beam once inside the mass spectrometer. Pollard et al. describe the use of an electron impact technique to ionize the molecular supersonic jet stream. By using electron impact ionization after expansion, the narrow energy distribution of the molecules in the supersonic jet is destroyed and the ions produced have very different kinetic and internal energies. This adversely affects the resolution of the mass spectrometer. Electron impact is a widely used ionization technique even though it is not a very effective ionization process. With a less effective ionization process, a larger sample must be used in order to assure that enough of the chemical species or compounds are ionized to give an acceptable response at the detector.

It is most advantageous to position the flight tube at or near a 90 degree angle to the axis of the supersonic jet stream flow. The forward movement of the ions before being directed into the flight tube has little or no effect on the rate of movement up the field-free flight tube. Thus, the resolution is not affected by the forward movement along the beam axis when the flight tube is off axis. The forward momentum may present a problem if the flight tube is narrow, because such momentum will force the molecules into the side of the flight tube. Different methods can be applied to overcome this problem. For example, a repelling field potential could be used to force the ions away from the flight tube wall.

Using a corona discharge or $^{63}$Ni Beta ion source, or other technique for the production of ions outside the reduced pressure or vacuum chamber of the mass spectrometer, a supersonic jet of ions can be obtained wherein the internal and kinetic energies of each ion fall within a relatively narrow energy band. Any sources of ion production could be used in order to produce a source of ions near the orifice through which the ions are moved in order to form the supersonic jet. Other sources include, but are not limited to, the use of laser, thermospray and electrospray ionization techniques.

The corona discharge and the $^{63}$Ni Beta ion sources are very sensitive and are very effective in the production of ions required to form the supersonic jet. Primary ions are created by these ion sources and the analyte molecules are ionized through ion-molecule reactions with primary ions. These reactions were first studied by Good et al., "Mechanism and Rate Constants of Ion-Molecule Reactions Leading to Formation of H+(H2O)n in Moist Oxygen and Air" J. Chem. Phys., Vol., 52, No. 1, (1970), p. 222. Due to the long residence time of the molecules inside the ionization chamber, a large percentage of molecules are ionized. The ionization does not cause extensive fragmentation such as that observed in electron impact ionization which is usually performed in a vacuum state. Because extensive fragmentation does not occur, the mass spectra produced, which contain parent and fragment ion signals, or peaks, are simpler, and it is easier to detect the molecules of interest.

The present invention provides for ionization of the chemical species at or near atmospheric or ambient pressure. This is advantageous because ionization and mass spectral analysis of effluents from liquid chromatographs, gas chromatographs, and supercritical fluid chromatographs can be easily achieved, because the necessary special adaptations to introduce the effluent, which is often under ambient or higher pressures, into the vacuum of the mass spectrometer are much simpler.

The ionization could actually be carried out at any pressure, but atmospheric pressure is usually the most convenient. Provided the pressure in the ionization region is significantly higher than the pressure inside the mass spectrometer apparatus, the ion jet is formed by simply making the orifice open freely between the two pressure regions. The vacuum inside the mass spectrometer draws the ionized chemical species through the orifice because of the pressure differential, and the supersonic jet is formed.

A charged surface could be used to attract or repel the ions created in the ionization region toward the orifice to create a supersonic jet with a higher concentration of ions. By providing a jet of high ion concentration, the detection limits of the analysis can be increased.

The diameter of the orifice connecting the ion production region and the vacuum chamber of the mass spectrometer is on the order of 10 microns to 500 microns. If a larger orifice is used, a larger vacuum pumping system must also be used. However, a larger orifice provides a better narrowing of the internal and kinetic energy distributions because of increased possibilities for two body collisions.

It may be desirable in some cases to introduce a gas species into the ion production region in order to increase ion production or increase ion concentration in the supersonic ion jet.

SUMMARY OF THE INVENTION

The present invention is a chemical species analyzer comprising an ion source at or near ambient pressure and a time-of-flight mass spectrometer which receives the ions, created at the ion source, through a supersonic jet. The ion source creates ions from neutral molecules in the sample to be analyzed or serves to introduce already formed ions into the mass spectrometer vacuum chamber. The ion source can use any of the known techniques for ion creation, including a corona discharge or a $^{63}$Ni Beta ion source. The ions are created and are then introduced into the vacuum region of the mass spectrometer through a small orifice which causes the stream of ions entering the vacuum region to enter as a supersonic jet wherein the kinetic-energy of each individual ion falls within a narrow energy band. The ions are then repelled or drawn into the field-free flight tube of the mass spectrometer and separated and identified based on their mass-to-charge ratios. The ions have similar kinetic energies because of their interactions encountered in the expansion of the supersonic jet. The energy levels of the ions can be brought into an even narrower energy band by using a reflection device. By having each ion enter the flight tube with similar kinetic energy as the kinetic energy of the other ions, the resolution of the mass spectrometer can be increased. Additional ion focusing devices can be used to increase the resolution.

Accordingly, one object of this invention is to provide a simplified apparatus and method for mass detection in the art of chromatographic analysis.

Another object of this invention is to provide a simplified method of introducing ions into a time-of-flight mass spectrometer.

Another object of this invention is to increase the resolution of a time-of-flight mass spectrometer.

Another object of this invention is to provide an apparatus which can routinely be used to detect substances at very low concentration levels.

Another object of this invention is to provide an apparatus and a method for quickly detecting very low levels of a specific substance.

These and other objects and features of the present invention will become more readily apparent as the apparatus and methods of practicing the invention from the following description.

DETAILED DESCRIPTION OF THE INVENTION

Figure 1:
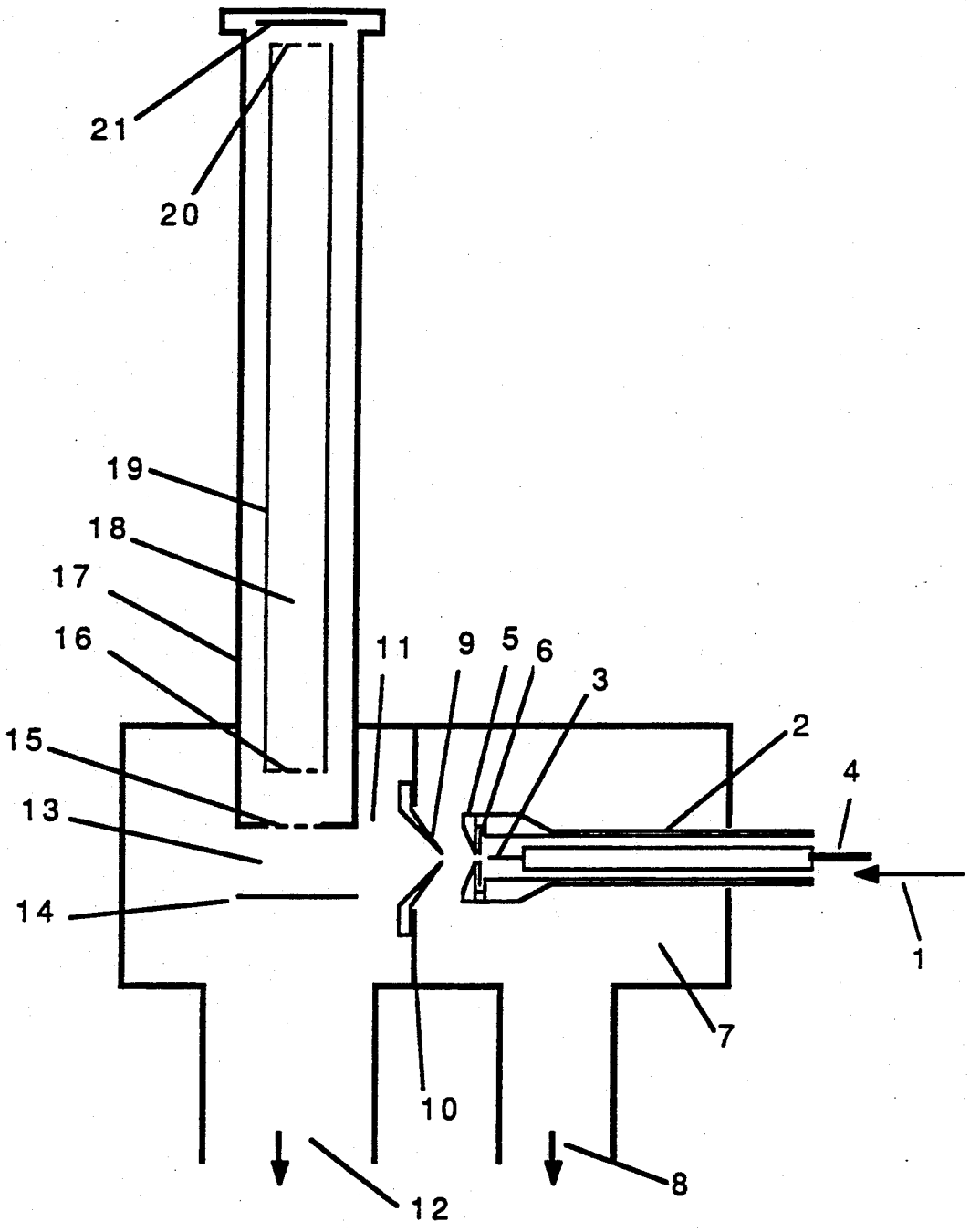
FIG. 1 shows an analyzer of the present invention employing a corona discharge ion source.

The invention is best understood by reference to the following description, appended claims, and the drawings wherein the parts are designated with like numerals throughout. The present invention is a highly sensitive chemical species analyzer which consists of an ion source operated in a chamber at ambient pressure and a time-of-flight mass spectrometer. A small orifice is placed between the ion source and the mass spectrometer. By introducing the ions into the mass spectrometer through such small orifice, a supersonic jet is created which has the effect of narrowing the distribution of internal and kinetic energies of the ions. With the supersonic jet effect, the mass resolution of the time-of-flight mass spectrometer can be improved.

At a selected distance from the opening, which can be any geometric configuration, the ions are forced to change their flight direction under the influence of a potential pulse applied to repel or attract the ions off axis of their flow within the supersonic jet. The ions exposed to the potential pulse are directed into the field-free ion drift tube. Once inside the drift tube, the ions are separated in time according to their mass-to-charge ratios. Generally, lighter ions arrive earlier than heavier ions at a micro-channel plate detector which is positioned at the end of the ion flight path. Groups of ions arriving at different times are then used to generate a time-of-flight mass spectrum, which can be displayed on an oscilloscope, synchronized with the potential pulses mentioned above, or assimilated by a computer or otherwise recorded.

The ion source can be a corona discharge or a $^{63}$Ni Beta ion source. A corona discharge is formed by applying a large voltage difference across a small gap between a needle point and a metal plate. In this case, a steel needle and a plate with a laser drilled orifice separating the ion source and the mass spectrometer are used. Once the ions are produced, they all migrate into the mass spectrometer through the orifice or small opening. The voltage applied to the needle is usually a few thousand volts which is sufficient to cause a discharge between the needle and the plate in which the orifice is formed. In the discharge, primary ions are formed due to electron bombardment of the reagent gas. Reagent gases such as air, nitrogen, argon, helium and many other gases can be introduced and mixed with the chemical species or analytes of interest. With a large number of collisions between the primary ions and neutral molecules of the analytes at or near ambient pressure, secondary ions are formed through ion-molecule reactions.

In a supersonic jet, the random translational energies of the ions are transformed into a directed flow toward a lower pressure region. Subsequently, the kinetic energy distribution of ions inside the expanding jet is narrowed. One of the major contributions to the poor resolution in conventional time-of-flight mass spectrometers is the broad initial energy spread of the ions. The supersonic ion jet reduces the energy spread and improves the mass resolution.

As the supersonic jet stream of ions passes the opening to the mass spectrometer flight tube, the ions are directed into the flight tube using a pulsed electric field. The ions can be repelled or drawn into the flight tube depending upon the configuration of the electric field used to accelerate the ions into the flight tube. After being directed from the supersonic jet path toward the flight tube and before entering the flight tube, the ions pass through a grounded grid which shields the ion jet from the focusing fields applied to further improve the resolution. A second grid with an applied electric field is positioned between the grounded grid and the flight tube to focus the ions and compensate for the loss of resolution resulting because the ions do not begin their flight toward the flight tube from identical positions.

The potential between the electric field used to change the direction of the ions toward the flight tube and the electric field applied to the second grid can be adjusted to minimize ion peak broadening due to different distances of the ions from the grounded grid. The electric fields between the plate used to repel or attract the ions into the flight tube, the grounded grid, and the second grid provide a focusing effect described as space-focusing in the paper by Wiley and McLaren. This focusing effect will compensate for the differences in flight time caused by different positions of the ions inside the acceleration region at the start of each pulse. With space focusing, mass resolution will now mainly be dependent on the initial energy spread of the ions entering the acceleration region.

It is also critical to have the drift tube off-axis to the ion flow direction, so that the forward motion of the ions does not interfere with the analysis. If the flight tube is on-axis with the ion beam flow direction, the continual flow of ions into the flight tube must be controlled or the analysis will be impossible. A very narrow pulse is required to control the entrance of the ions into the flight tube when it is on-axis. It is difficult to achieve such a narrow pulse which must be only a few tens of nanoseconds long. Once inside the field-free drift region of the flight tube, the ions travel at constant velocities dependent on their mass-to-charge ratios. The arrival time is then dependent on the square root of the mass-to-charge ratio. For molecules of a few hundred mass units, the flight times are usually less than 50 microseconds. The ions are detected at the end of the flight path by a micro-channel plate electron multiplier, or other detector apparatus. If used, a micro-channel plate multiplier has sub-nanosecond rise time and thus contributes very little to the ion peak widths.

An ion reflector can also be added to the analyzer to further focus the ions. In this case, ions are first pulsed away from the drift tube into the ion reflector and are then reflected back toward the drift tube using applied electric fields. The ion reflector is composed of a plurality of potential rings, which provide a retarding field. For ions of the same molecular weight, the faster and hence more energetic ions will penetrate deeper into the retarding field and spend more time inside the reflector. In this way, the slower ions can then "catch up" with the more energetic ions. This reflector thus serves as a device to minimize the difference in the flight times for ions of the same molecular weight.

Figure 2:
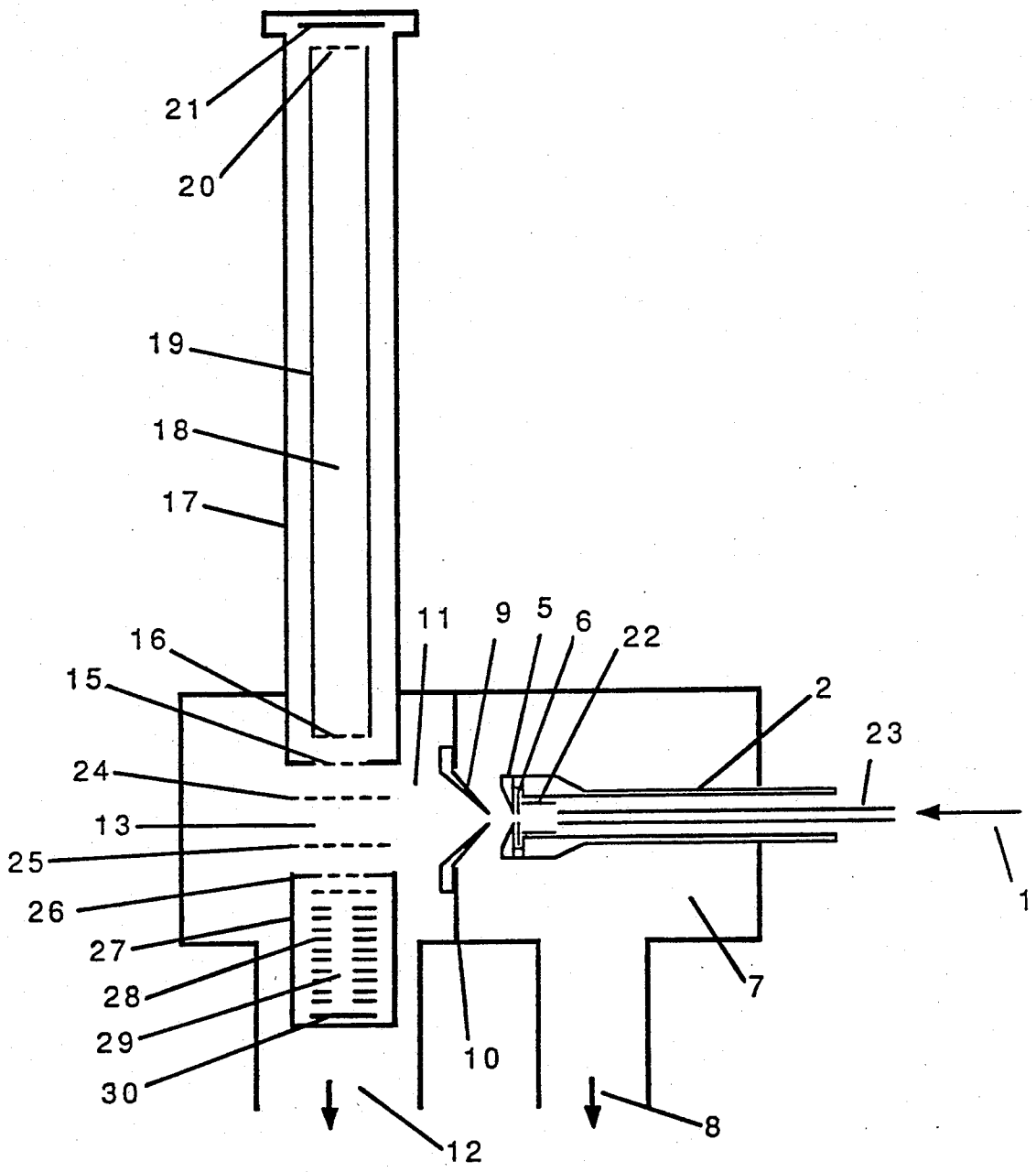
FIG. 2 shows an analyzer of the present invention with a reflector and a $^{63}$Ni Beta ion source.

The mass spectrometer is pumped by one or more vacuum pumps. In FIGS. 1 and 2, two chambers are used to "step down" from the pressure of the ionization chamber to the vacuum region of the drift tube. The chambers are separated by a partition with a "skimmer" orifice connecting the chambers. This combination of chambers is used to reduce the size of the vacuum pumping systems required to maintain the vacuum in the drift tube. A single chamber could be used or a multiplicity of chambers could be used.

The complete apparatus housing and the ion source assembly (2) are electrically grounded. The first vacuum compartment (7) is pumped by a 2-inch diffusion pump maintaining a pressure of approximately $10^{-3}$ Torr. The second vacuum compartment (11) is pumped by a 4-inch diffusion pump maintaining a pressure of approximately $10^{-5}$ Torr. A laser drilled pinhole orifice in plate (6) is positioned at the end of the ion source assembly (2). The exit plate (5) and the orifice plate (6) are electrically insulated from the assembly (2) so that a potential can be applied to them for focusing ions toward the center of the skimmer (9). The chemical species to be analyzed (1), which could be ambient air, effluent from a chromatograph, or any other sample stream is directed into the ion source.

If a corona discharge ion source is used as shown in FIG. 1, the needle (3) is held in proximity to, and is electrically insulated from the ion source assembly (2). The connection between the needle and the power supply is a high voltage coaxial cable (4). Several thousand volts are sufficient for discharging, if the needle is only a few millimeters- from the orifice in plate (6).

If a $^{63}$Ni Beta ion source is used as shown in FIG. 2, the radioactive substance is coated onto the inner surface of a ring (22). The ring (22) is then positioned at the end of the ion source assembly (2), allowing the analytes from tube (23) to flow through the ring's center. The exit plate (5) has an orifice opening into the mass spectrometer in a 120° conical shape to minimize shock wave interferences on the jet. A potential less than 100 V is applied to the exit plate (5) to focus ions toward the skimmer orifice in skimmer (9). The skimmer (9) is mounted at the center of the wall (10) between the two vacuum compartments. The skimmer cone has a total angle of about 90° to the wall (10) on the interior side of chamber (11) which helps preserve the supersonic ion jet.

In the second vacuum compartment (11), ions enter the acceleration region (13) (area where the ions are pulsed or accelerated down the flight tube) between the repeller plate (14) and the field-free flight tube (17). As a potential pulse is applied onto the repeller plate (14), ions will be pushed into the field-free flight tube or drift tube (17). After passing the grounded grid (15), the ions experience another pull from the potential applied to grid (16). The potential on grid (16) can be adjusted to minimize ion peak broadening due to differences in the distance of the ions from the pulsed electrode or repeller plate (14) at the time when the pulse is applied. The field-free drift region (18) is shielded from the grounded chamber housing by steel tube (19) with grids (16) and (20) on the ends. Inside flight tube (19), each ion will travel at a constant velocity, which velocity is inversely proportional to the square root of its molecular weight.

The detection of ions is performed by using micro-channel plate electron multiplier (21). Electron multipliers usually have a horn-like configuration, which is not suitable for time-of-flight detection, because the arrival time varies with the radial positions of the incoming ions. Therefore, the flat micro-channel plate electron multiplier (21) is used in this apparatus. The micro-channel electron multiplier (21) yields a signal rise time of less than one nanosecond, which is negligible when compared to ion flight times in the microsecond regime. Thus, the detector does not contribute to any significant loss in resolution.

As mentioned above, an ion reflector can be added to the present system to further improve the mass resolution as shown in FIG. 2. The ion reflector (27) is placed opposite the flight tube (19), across the flow path of the ion jet. The repeller (14) of FIG. 1 is replaced by the grid (24). Grounded grids (25 and 26) are positioned to shield the ion jet from the potential field of the reflector. Ions repelled into the reflector pass through these grids, and ions not repelled or pushed into the reflector continue on along the jet path without being influenced by the potential in the reflector region. The grid (24) is positioned so that ions are pulsed into the ion reflector (27) before being directed into the flight tube (19).

The ion reflector (27) has a plurality of potential rings (28). In the central channel of the reflector (29), ions are exposed to a potential field which has the same polarity as the analyte ions. After the ions enter the potential field established by rings (28), they are repelled back out of the reflector channel (29) toward the flight tube (19). Each ring (28) has a potential which ideally is adjusted independently. The potential of the rings increases sequentially with distance from the ion beam from lowest to highest potential, and the last element (30) inside the reflector is a well polished plate with the highest potential of all. The ions entering the reflector are slowed down and repelled back. The ions then pass through grid (24), which at that point does not have a potential charge and is grounded similar to the grids (25 and 26) through which the ions also pass before entering the flight tube (19). The ions then enter the field-free drift tube (19) and are detected by the micro-channel plate electron multiplier (21).

Although both positive and negative ions are formed in the ionization source, and either could be detected, only detection of positive ions is described in this description. Typical voltages used for the discharge source and grids are listed in Table 1. Typical dimensions between the system components and of the ion source and skimmer orifices are listed in Table 2.

TABLE 1

| Typical Voltages | |
|---|---|
| Voltage of discharge needle (3): | +1,000 to +4,000 V |
| Voltage of repeller plate (14): | +400 V |
| Voltage of second grid (16): | −1,200 to −2,000 V |

TABLE 2

| Typical Dimensions | |
|---|---|
| Distance from (14) to (15): | 3 cm |
| Distance from (15) to (16): | 2 cm |
| Distance from (16) to (20): | 135 cm |
| Internal diameter of ion source orifice (6): | 10 to 500 × $10^{-6}$ m (micron) |
| Internal diameter of skimmer orifice (9): | 200 to 1500 micron |

Having thus described and illustrated the invention with reference to specific embodiments, those trained in the art will recognize that modifications and alternations may be made without departing from the principles of the invention as described herein and set forth in the following claims.

Having thus described and illustrated the invention, what is claimed is:

1. An apparatus for chemical species analysis using a time-of-flight mass spectrometer comprising:
   ion production means for the production of ions or introduction of already produced ions in a region exterior to a vacuum region of the said time-of-flight mass spectrometer;
   introduction means for permitting the produced ions to flow from the ion production region into said vacuum region of said time-of-flight mass spectrometer, such that the ion flow forms a supersonic jet; and
   ion flow directing means for changing the ion flow direction from a supersonic jet flow axis into a flight tube of said time-of-flight mass spectrometer where the ions are separated and detected.

2. An apparatus according to claim 1, wherein said ion production means is a corona discharge.

3. An apparatus according to claim 1, wherein said ion production means is a $^{63}$Ni Beta ion source.

4. An apparatus according to claim 1, wherein said region exterior to the vacuum region of said time-of-flight mass spectrometer is at or near ambient pressure.

5. An apparatus according to claim 1, wherein the ions flow from said ion production region into said vacuum region of said time-of-flight mass spectrometer through an orifice having an opening dimension greater than the mean-free path of the ions.

6. An apparatus according to claim 5, wherein said orifice is a circular hole with a diameter between 10 and 500 microns.

7. An apparatus according to claim 1, wherein said ion flow directing means is an electric field created by an applied voltage of the same charge as the ions.

8. An apparatus according to claim 7, wherein said voltage is applied to a repeller plate which is parallel to a surface of a micro-channel plate electron multiplier with the supersonic jet between the repeller plate and the opening to said time-of-flight mass spectrometer flight tube.

9. An apparatus according to claim 1, wherein said ion flow directing means is an electric field created by an applied voltage of opposite charge as the ions.

10. An apparatus according to claim 9, wherein said voltage is applied to a grid positioned parallel to a surface of a micro-channel plate electron multiplier, and the supersonic jet is on the opposite side of the grid from the opening to said time-of-flight mass spectrometer flight tube.

11. An apparatus for the detection of chemical species using a time-of-flight mass spectrometer comprising;
   an ion production means exterior to a vacuum region of said time-of-flight mass spectrometer;
   means for introducing the produced ions into a vacuum region of said time-of-flight mass spectrometer;
   means for creating an ion supersonic jet which narrows the distribution of kinetic and internal energies of the produced ions;
   means for changing the direction of the ions and directing them into an entrance of a flight tube of said time-of-flight mass spectrometer, where the ions are identified;
   means for improving the resolution of said time-of-flight mass spectrometer; and means for obtaining a mass spectrum from the mass analysis of the ions.

12. An apparatus according to claim 11, wherein said ion production means is at or near ambient pressure.

13. An apparatus according to claim 11, wherein said ion production means is a corona discharge.

14. An apparatus according to claim 11, wherein said ion production means is a $^{63}$Ni Beta ion source.

15. An apparatus according to claim 11, wherein the ion supersonic jet is formed by allowing the produced ions to flow from a region of higher pressure to a region of significantly lower pressure through an opening which has a dimension larger than the mean-free path of the ions flowing therethrough.

16. An apparatus according to claim 15, wherein said means for introducing the produced ions into the vacuum region of said time-of-flight mass spectrometer is said opening.

17. An apparatus according to claim 15, wherein said opening is circular.

18. An apparatus according to claim 17, wherein the diameter of said opening is between 10 and 500 microns.

19. An apparatus according to claim 11, wherein the vacuum region of said time-of-flight mass spectrometer is divided into two chambers of different pressure with an opening between the two chambers.

20. An apparatus according to claim 19, wherein said opening is formed in a manner which allows the ion supersonic jet to pass between the said chambers with a minimum of interference.

21. An apparatus according to claim 19, wherein said opening is a skimmer.

22. An apparatus according to claim 11, wherein said means for changing the direction of the ions is a pulsed electric field.

23. An apparatus according to claim 22, wherein the electric field is produced by a voltage potential of the same polarity as the ions in the supersonic jet, applied to a surface positioned such that the ion supersonic jet axis is between the surface and the entrance to said time-of-flight mass spectrometer flight tube and such that the surface is parallel to the surface of a micro-channel plate of an electron multiplier.

24. An apparatus according to claim 22, wherein the electric field is produced by a voltage potential, of the opposite polarity as the ions in the supersonic jet, applied to a surface positioned such that the surface is between the ion supersonic jet axis and an entrance of said time-of-flight mass spectrometer flight tube and such that the surface is parallel to a surface of a micro-channel plate electron multiplier.

25. An apparatus according to claim 22, wherein the electric field is positioned such that the ions are directed into said means for improving the resolution of said time-of-flight mass spectrometer.

26. An apparatus according to claim 11, wherein said means for improving the resolution comprises an electric field having the same polarity as the ions.

27. An apparatus according to claim 26, wherein the electric field is formed by a plurality of rings which provide a retarding field for the directional motion of the ions directed into the field from the supersonic jet.

28. An apparatus according to claim 26, wherein the electric field is configured such that the ions are repelled out of the electric field and are directed into a field-free region of said time-of-flight mass spectrometer flight tube.

29. An apparatus according to claim 11, wherein said flight tube of said time-of-flight mass spectrometer is positioned with its length perpendicular to the supersonic jet flow axis.

30. An apparatus according to claim 11, wherein said means for improving the resolution of said time-of-flight mass spectrometer comprises an ion reflector.

31. An apparatus according to claim 11, wherein said means for improving the resolution of the said time-of-flight mass spectrometer is shielded from the ion supersonic jet by a grounded surface.

32. An apparatus according to claim 11, wherein said means for improving the resolution of the said time-of-flight mass spectrometer comprises a system of space focusing ion optics.

33. A method for analyzing chemical species using a time-of-flight mass spectrometer comprising the steps of:

producing ions in a region exterior to a vacuum region of said time-of-flight mass spectrometer;

introducing the ions into the vacuum region of the said time-of-flight mass spectrometer;

creating an ion supersonic jet;

directing the ions into a flight tube of said time-of-flight mass spectrometer, which flight tube is positioned off axis to the directional flow of the ion supersonic jet;

focusing the ions to obtain improved mass resolution of said time-of-flight mass spectrometer; and obtaining a mass analysis from said time-of-flight mass spectrometer.

34. A method as set forth in claim 33, further comprising the step of producing the ions using a corona discharge.

35. A method as set forth in claim 33, further comprising the step of producing the ions using a $^{63}$Ni Beta ion source.

36. A method as set forth in claim 33, further comprising the step of introducing the ions into the vacuum region of said time-of-flight mass spectrometer through an opening which has a dimension larger than the mean-free path of the ions passing therethrough.

37. A method as set forth in claim 36, further comprising the step of forming the ion supersonic jet allowing the ions to flow between a region of higher pressure and a region of significantly lower pressure through said opening.

38. A method as set forth in claim 33, further comprising the step of narrowing the kinetic and internal energy distribution of the ions produced by supersonic jet expansion.

39. A method as set forth in claim 33, further comprising the step of directing the ions into said flight tube of said time-of-flight mass spectrometer through the use of an electric field.

40. A method as set forth in claim 33, further comprising the step of positioning said flight tube of the said time-of-flight mass spectrometer such that the ions must be diverted off axis of the ion supersonic jet in order to enter the flight tube.

41. A method as set forth in claim 39, further comprising the step of providing the electric field with a polarity opposite to that of the ions in the supersonic jet.

42. A method as set forth in claim 39, further comprising the step of providing the electric field with a polarity same as that of the ions in the supersonic jet.

43. A method as set forth in claim 33, further comprising the step of positioning the length of the flight tube perpendicular to the axis of flow of the ion supersonic jet.

44. A method as set forth in claim 41, further comprising the step of forming the electric field by applying a voltage to a surface which will attract ions in the supersonic jet and allowing the ions to pass through the flight tube of said time-of-flight mass spectrometer.

45. A method as set forth in claim 42, further comprising the step of forming the electric field by applying a voltage to a surface positioned to repel the ions in the supersonic jet into the flight tube of the said time-of-flight mass spectrometer.

46. A method as set forth in claim 33, further comprising the step of focusing the ions to obtain improved mass resolution in the said time-of-flight mass spectrometer by using an electric field which directs the ions from the supersonic jet into an ion reflector.

47. A method as set forth in claim 46, further comprising the step of providing an ion reflector which comprises a plurality of rings to form a retarding electric field for the directional motion of the ions directed into the field from the supersonic jet.

48. A method as set forth in claim 46, further comprising the step of repelling the ions out of the reflector and directing the ions into a field-free region of said time-of-flight mass spectrometer flight tube.

49. A method as set forth in claim 33, further comprising the step of providing the vacuum region of the said time-of-flight mass spectrometer with two chambers having different pressure and with an opening in between said two chambers.

50. A method as set forth in claim 49, further comprising the step of providing said opening with a skimmer.

51. A method as set forth in claim 33, further comprising the step of shielding the ion supersonic jet from a reflector field by means of a grounded grid.

* * * * *

US005070240B1

REEXAMINATION CERTIFICATE (2991th)

United States Patent [19] [11] B1 5,070,240

Lee et al. [45] Certificate Issued Sep. 10, 1996

[54] APPARATUS AND METHODS FOR TRACE COMPONENT ANALYSIS

[75] Inventors: Milton L. Lee, Pleasant Grove; Chung H. Sin, Provo, both of Utah

[73] Assignee: Brigham Young University, Provo, Utah

Reexamination Request:
No. 90/004,095, Jan. 16, 1996

Reexamination Certificate for:

| | |
|---|---|
| Patent No.: | **5,070,240** |
| Issued: | **Dec. 3, 1991** |
| Appl. No.: | **574,638** |
| Filed: | **Aug. 29, 1990** |

[51] Int. Cl.[6] ..... H01J 49/40
[52] U.S. Cl. ..... 250/288; 250/287; 250/286
[58] Field of Search ..... 250/288, 288 A, 250/287, 286

[56] References Cited

U.S. PATENT DOCUMENTS 5,117,107 5/1992 Guilhaus et al. ..... 250/287

FOREIGN PATENT DOCUMENTS 9103071 3/1991 WIPO .

OTHER PUBLICATIONS

Proctor et al., Organic Mass Spectrometry, vol. 18, No. 12, 1983, pp. 509–516.
Dawson et al., Rapid Communications in Mass Spectrometry, vol. 3, No. 5, 1989.
Lubman, Laser Focus/Electro–Optics, Jun. 1984.
O'Halloran et al., Technical Documentary Report No. ASD–TDR–62–644, Part I, Apr. 1964.
Christopher J. Proctor & John F. J. Todd, Atmospheric Pressure Ionization Mass Spectrometry, 18 Org. Mass Spectrom, 509 (1983).
J. H. J. Dawson & M. Guilhaus, Orthogonal–acceleration Time–of–flight Mass Spectrometer, 3 Rapid Commun. Mass Spectrom. 155 (1989).
D. M. Lubman, Supersonic–Beam Techniquie Improves Resolution in Time–of–flight Mass Spectrometry, Lazer Focus/Electro–Optics (Jun. 1984).
G. J. O'Halloran et al., Determination of Chemical Species Prevalent in a Plasma Jet, Technical Documentary Report No. ASD–TDR–62–644, part I prepared under Contract AF 33(616)–8374 by the Bendix Corp. Research Laboratories (1964).

*Primary Examiner*—Jack I. Berman

[57] ABSTRACT

A method an apparatus for analyzing chemical species includes an ion source at or near ambient pressure and a time-of-flight mass spectrometer which receives the ions, created at the ion source, through an ion supersonic jet forming device. The ion source creates ions from neutral molecules in the sample to be analyzed or serves to introduce already formed ions into the mass spectrometer vacuum chamber. The ion source can use any of the known techniques for ion creation, including a corona discharge or a $^{63}$Ni Beta ion source. The ions are created and are then introduced into the vacuum region of the mass spectrometer through a small orifice which causes the stream of ions entering the vacuum region to enter as a supersonic jet wherein the kinetic energy of each individual ion falls within a narrow energy band. The ions are then repelled or drawn into the field-free flight tube of the mass spectrometer and separated and identified based on their mass-to-charge ratios.

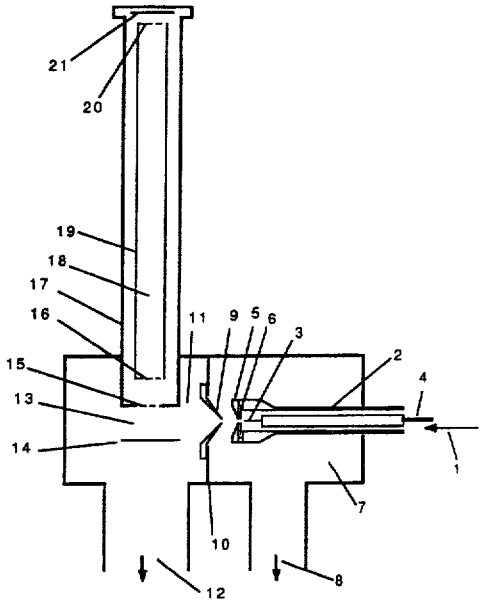

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 38 is cancelled.

Claims 1, 11 and 33 are determined to be patentable as amended.

Claims 2–10, 12–32, 34–37 and 39–51, dependent on an amended claim, are determined to be patentable.

1. An apparatus for chemical species analysis using a time-of-flight mass spectrometer comprising:

ion production means for [the production of ions or introduction of already produced] *receiving a selected sample of chemical species to be analyzed and producing* ions *therefrom* in a region exterior to a vacuum region of the said time-of-flight mass spectrometer;

introduction means for permitting the produced ions to flow *continuously* from the ion production region into said vacuum region of said time-of-flight mass spectrometer, such that the ion flow forms a supersonic jet *which narrows the distribution of kinetic and internal energies of the produced ions*; and ion flow directing means for changing the ion flow direction from a supersonic jet flow axis into a flight tube of said time-of-flight mass spectrometer where the ions are separated and detected.

11. An apparatus for the detection of chemical species using a time-of-flight mass spectrometer comprising:

an ion production means *for receiving a selected sample of chemical species to be analyzed and producing ions therefrom, wherein said ion production means is* exterior to a vacuum region of said time-of-flight mass spectrometer;

means for *continuously* introducing the produced ions into a vacuum region of said time-of-flight mass spectrometer;

means for creating an ion supersonic jet which narrows the distribution of kinetic and internal energies of the produced ions;

means for changing the direction of the ions and directing them into an entrance of a flight tube of said time-of-flight mass spectrometer, where the ions are identified;

means for improving the resolution of said time-of-flight mass spectrometer; and means for obtaining a mass spectrum from the mass analysis of the ions.

33. A method for analyzing chemical species using a time-of-flight mass spectrometer comprising the steps of:

producing ions *from a selected sample of chemical species to be analyzed* in a region exterior to a vacuum region of said time-of-flight mass spectrometer;

*continuously* introducing the ions into the vacuum region of [the] said time-of-flight mass spectrometer;

creating an ion supersonic jet *such that the distribution of kinetic and internal energies of the ions is narrowed*;

directing the ions into a flight tube of said time-of-flight mass spectrometer, which flight tube is positioned off axis to the directional flow of the ion supersonic jet;

focusing the ions to obtain improved mass resolution of said time-of-flight mass spectrometer; and obtaining a mass analysis from said time-of-flight mass spectrometer.

* * * * *

US005070240C2

(12) EX PARTE REEXAMINATION CERTIFICATE (6564th)

United States Patent

Lee et al.

(10) Number: US 5,070,240 C2

(45) Certificate Issued: Dec. 9, 2008

(54) APPARATUS AND METHODS FOR TRACE COMPONENT ANALYSIS

(75) Inventors: Milton L. Lee, Pleasant Grove, UT (US); Chung H. Sin, Provo, UT (US)

(73) Assignee: Norwest Business Credit, Inc., Denver, CO (US)

Reexamination Request:
No. 90/007,437, Feb. 24, 2005

Reexamination Certificate for:

| | |
|---|---|
| Patent No.: | **5,070,240** |
| Issued: | **Dec. 3, 1991** |
| Appl. No.: | **07/574,638** |
| Filed: | **Aug. 29, 1990** |

Reexamination Certificate B1 5,070,240 issued Sep. 10, 1996

(51) Int. Cl.

| | |
|---|---|
| ***H01J 49/04*** | (2006.01) |
| ***H01J 49/16*** | (2006.01) |
| ***H01J 49/40*** | (2006.01) |
| ***H01J 49/02*** | (2006.01) |
| ***H01J 49/34*** | (2006.01) |
| ***H01J 49/10*** | (2006.01) |

(52) U.S. Cl. ..... 250/288; 250/286; 250/287

(58) Field of Classification Search ..... None
See application file for complete search history.

(56) References Cited

U.S. PATENT DOCUMENTS

| | | | | |
|---|---|---|---|---|
| 4,209,696 A | * | 6/1980 | Fite | 250/281 |
| 4,390,784 A | | 6/1983 | Browning et al. | |
| 4,731,532 A | | 3/1988 | Frey et al. | |
| 5,130,538 A | * | 7/1992 | Fenn et al. | 250/282 |

OTHER PUBLICATIONS

Technical Document Report No. ASD TDR 62–644, Part I entitled "Determination of Chemical Species Prevalent in a Plasma Jet", dated Apr. 1964.

Technical Document Report No. ASD TDR 62–644; Part II entitled "Determination of Chemical Species Prevalent in a Plasma Jet", dated Nov. 1964.

W.C. Wiley, et al., "Time–of–Flight Mass Spectrometer with Improved Resolution", *The Review of Scientific Instruments,* vol. 26, No. 12, Dec. 1955, pp. 1150–1157.

Christopher J. Proctor, et al., "Atmospheric Pressure Ionization Mass Spectrometry", *Organic Mass Spectrometry,* vol. 18, No. 12, 1983, pp. 509–516.

J.E. Pollard, et al., "Electron–Impact Ionization Time–of–Flight Mass Spectrometer for Molecular Beams", *The Review of Scientific Instruments,* vol. 58, No. 1, Jan. 1987, pp. 32–37.

J.H.J. Dawson, et al., "Orthogonal–acceleration Time–of–Flight Mass Spectrometer", *Rapid Communications in Mass Spectrometry,* vol. 3, No. 5, 1989, pp. 155–159.

* cited by examiner

*Primary Examiner*—Erik Kielin

(57) ABSTRACT

A method an apparatus for analyzing chemical species includes an ion source at or near ambient pressure and a time-of-flight mass spectrometer which receives the ions, created at the ion source, through an ion supersonic jet forming device. The ion source creates ions from neutral molecules in the sample to be analyzed or serves to introduce already formed ions into the mass spectrometer vacuum chamber. The ion source can use any of the known techniques for ion creation, including a corona discharge or a $^{63}$Ni Beta ion source. The ions are created and are then introduced into the vacuum region of the mass spectrometer through a small orifice which causes the stream of ions entering the vacuum region to enter as a supersonic jet wherein the kinetic energy of each individual ion falls within a narrow energy band. The ions are then repelled or drawn into the field-free flight tube of the mass spectrometer and separated and identified based on their mass-to-charge ratios.

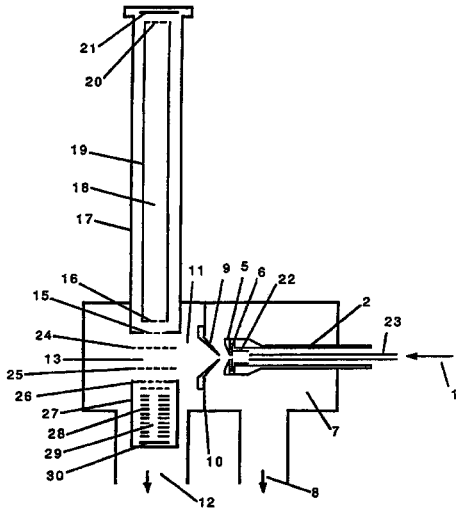

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 38 was previously cancelled.

Claims 1–30, 32–37 and 39–50 are cancelled.

Claims 31 and 51 are determined to be patentable as amended.

31. An apparatus [according to claim 11,] *for the detection of chemical species using a time-of-flight mass spectrometer comprising:*

*an ion production means for receiving a selected sample of chemical species to be analyzed and producing ions therefrom, wherein said ion production means is exterior to a vacuum region of said time-of-flight mass spectrometer;*

*means for continuously introducing the produced ions into a vacuum region of said time-of-flight mass spectrometer;*

*means for creating an ion supersonic jet which narrows the distribution of kinetic and internal energies of the produced ions;*

*means for changing the direction of the ions and directing them into an entrance of a flight tube of said time-of-flight mass spectrometer, where the ions are identified;*

*means for improving the resolution of said time-of-flight mass spectrometer; and*

*means for obtaining a mass spectrum from the mass analysis of the ions,* wherein said means for improving the resolution of the said time-of-flight mass spectrometer is shielded from the ion supersonic jet by a grounded surface.

51. A method [as set forth in claim 33,] *for analyzing chemical species using a time-of-flight mass spectrometer comprising the steps of:*

*producing ions from a selected sample of chemical species to be analyzed in a region exterior to a vacuum region of said time-of-flight mass spectrometer;*

*continuously introducing the ions into the vacuum region of said time-of-flight mass spectrometer;*

*creating an ion supersonic jet such that the distribution of kinetic and internal energies of the ions is narrowed;*

*directing the ions into a flight tube of said time-of-flight mass spectrometer, which flight tube is positioned off axis to the directional flow of the ion supersonic jet;*

*focusing the ions to obtain improved mass resolution of said time-of-flight mass spectrometer; and*

*obtaining a mass analysis from said time-of-flight mass spectrometer,* further comprising the step of shielding the ion supersonic jet from a reflector field by means of a grounded grid.

* * * * *